US009890643B2

(12) United States Patent
Truelle et al.

(10) Patent No.: US 9,890,643 B2
(45) Date of Patent: Feb. 13, 2018

(54) METHOD OF MANUFACTURING A CERAMIC CORE FOR MOBILE BLADE, CERAMIC CORE AND MOBILE BLADE

(71) Applicant: SNECMA, Paris (FR)

(72) Inventors: Franck Edmond Maurice Truelle, Argenteuil (FR); Alain Grandin, Asnieres sur Seine (FR); Maidin Mougamadou Aboudalcadar, Saint Mande (FR)

(73) Assignee: SNECMA, Paris (FR)

( * ) Notice: Subject to any disclaimer, the term of this patent is extended or adjusted under 35 U.S.C. 154(b) by 503 days.

(21) Appl. No.: 14/368,215

(22) PCT Filed: Dec. 20, 2012

(86) PCT No.: PCT/FR2012/053010

§ 371 (c)(1),
(2) Date: Aug. 28, 2014

(87) PCT Pub. No.: WO2013/093352

PCT Pub. Date: Jun. 27, 2013

(65) Prior Publication Data

US 2014/0369842 A1 Dec. 18, 2014

(30) Foreign Application Priority Data

Dec. 23, 2011 (FR) ..... 11 62358

(51) Int. Cl.

| | |
|---|---|
| ***B22C 9/04*** | (2006.01) |
| ***B22C 9/10*** | (2006.01) |
| ***B22C 21/14*** | (2006.01) |
| ***F01D 5/14*** | (2006.01) |
| ***B28B 1/24*** | (2006.01) |

(52) U.S. Cl.

CPC ..... *F01D 5/147* (2013.01); *B22C 9/04* (2013.01); *B22C 9/10* (2013.01); *B22C 21/14* (2013.01); *B28B 1/24* (2013.01); *F05D 2230/21* (2013.01); *F05D 2230/211* (2013.01)

(58) Field of Classification Search

CPC .. B22C 9/04; B22C 9/10; B22C 9/108; B22C 21/00; B22C 21/14

USPC ..... 164/15, 23, 28, 30, 33

See application file for complete search history.

(56) References Cited

U.S. PATENT DOCUMENTS

| | | | | |
|---|---|---|---|---|
| 4,532,974 | A * | 8/1985 | Mills et al. | B22C 9/106 164/132 |
| 2005/0133193 | A1* | 6/2005 | Beals et al. | B22C 7/02 164/516 |
| 2006/0171812 | A1* | 8/2006 | Albrecht et al. | F01D 5/147 416/190 |
| 2007/0025851 | A1* | 2/2007 | Guerche et al. | B22C 9/103 416/97 R |
| 2008/0164001 | A1* | 7/2008 | Morris et al. | B22C 9/04 164/369 |

FOREIGN PATENT DOCUMENTS

| | | |
|---|---|---|
| EP | 1 754 555 | 2/2007 |

OTHER PUBLICATIONS

International Search Report issued for International Application No. PCT/FR2012/053010, dated Jul. 5, 2013.

* cited by examiner

*Primary Examiner* — Kevin P Kerns

(74) *Attorney, Agent, or Firm* — Pillsbury Winthrop Shaw Pittman LLP

(57) ABSTRACT

A method of manufacturing a ceramic core for a blade including a lower part forming a core body, an upper part forming a squealer tip recess and a set of rods for holding the upper part and the lower part together, includes: coating the rods with a material that has a flash point below 1000° C.; positioning the rods in a mold; molding the upper and lower parts by injecting ceramic; firing the ceramic core.

11 Claims, 4 Drawing Sheets

METHOD OF MANUFACTURING A CERAMIC CORE FOR MOBILE BLADE, CERAMIC CORE AND MOBILE BLADE

CROSS REFERENCE TO RELATED APPLICATIONS

This application is the U.S. National Stage of PCT/FR2012/053010, filed Dec. 20, 2012, which in turn claims priority to French Patent Application No. 1162358 filed Dec. 23, 2011, the entire contents of all applications are incorporated herein by reference in their entireties.

FIELD

The field of the invention relates to methods of manufacturing ceramic cores used in lost wax moulding for manufacturing complex hollow blading for circulation of mobile blades. The invention is particularly applicable to the aeronautical field in which such blades can be used in aircraft engines.

STATE OF THE ART

The ceramic core is a discardable part that is used particularly to obtain the metal blading cooling circuit.

Firstly, cores are fabricated by injection of a polymer-ceramic mix into an injection tool. Secondly, the cores are subsequently fired to eliminate the polymer and to sinter the ceramic. Thirdly, the cores are deburred and impregnated with resin which gives them mechanical strength.

FIG. 1 shows a ceramic core body 10 comprising an upper part 2 forming a squealer tip recess and a lower part 1 forming a core body. The ceramic core is used for the blades, particularly turbine blades for an aircraft engine. In general, this type of blade is coupled to circular blading surrounding the blades. The part forming a recess forms an open cavity at the end of the blade. Functionally, the recess reduces centrifugal forces at the root of the blade and reduces heat transfer at the tip of the blade. It is fixed to the core body by the use of rods 3 that connect the core body to the recess. The rods may also be made of ceramic. In general, any material with a coefficient higher than the coefficient of expansion of the cores is suitable for making the rods.

One problem that arises with the manufacture of such cores is encountered during the firing step of said cores. The firing step follows the ceramic moulding step in a mould in which the rods are pre-positioned before injection of the material.

Once the rods 3 have been moulded connecting the core body to the recess, they are fixed to the moulded ceramic that has taken the shape of a recess and a core body. As the temperature rises during firing, the rods expand. FIG. 2 shows the result of expansion of a rod in the ceramic after firing, particularly due to the generation of a crack 20 forming open cracking 20 of the recess 2.

One solution consists of applying a local overthickness on the core facing the alumina rod.

FIG. 3 shows an overthickness 30 introduced so as to consolidate the part forming a crack after the ceramic has been fired along the recess at the level of the rods located inside the ceramic. The extra thickness is subsequently removed. Before the local overthickness has been cut flush, there were no visible cracks along the rod.

One disadvantage of this solution is that this overthickness has to be removed after firing, for example by manual grinding. It is found that the crack can once again appear on the recess during this operation. It then forms an open crack on the surface of the recess.

One major disadvantage is that the core is then unusable and potentially has to be scrapped.

SUMMARY OF THE INVENTION

The invention solves the above-mentioned disadvantages.

The purpose of the invention applies to a method of manufacturing a ceramic core for a blade comprising a lower part forming a core body, an upper part forming a squealer tip recess and a set of rods contributing to holding the upper part with the lower part. The method according to the invention comprises:

- a coating step, in which the rods are coated with a material with a flash point below a temperature threshold above which the expansion of the rod is greater than a predefined proportion;
- a step in which the rods are positioned in a mould;
- a step in which the upper and lower parts are moulded by a ceramic injection, the moulded parts thus forming a single part in the mould and defining a core shape;
- a step to fire the ceramic core.

According to one embodiment, the temperature threshold is 1000° C.

According to one embodiment, the expansion of the rod as a percent is 1%.

The ceramic core manufacturing method prevents cracking of the ceramic caused by the presence of rods during firing.

The method according to the invention particularly includes a preliminary step such as varnishing to coat at least one rod. Varnishing the rod can prevent cracking of the recess.

Each rod may be made of alumina or it may be made from a ceramic material with a coefficient higher than the coefficient of expansion of the cores.

Cracking is avoided by inflammation of the varnish during firing which releases a space between the fired ceramic and the expanded rod. The inflammation temperature of the varnish or an equivalent material covering the rods releases a space around the rod that expands at a temperature higher than the inflammation temperature of the varnish.

Advantageously, the steps are carried out in sequence.

Advantageously, a mould removal step (DEM) of the core precedes the core firing step (CUI).

Advantageously, each rod is coated on the surface that might be surrounded by the recess.

Advantageously, coating of part of the rods consists of a coat of varnish.

Advantageously, the coating of the rods consists of either:

- a deposit of a coat of wax on a part of the surface of each rod;
- a deposit of a coat of resin on a part of the surface of each rod;
- a deposit of a coat of graphite on a part of the surface of each rod.

The purpose of the invention also relates to a ceramic core for a turbine blade comprising a lower part forming a core body, an upper part forming a recess and a set of rods that contribute to holding the upper and lower parts together, characterised in that the core is made using a method according to the invention.

The invention also relates to a blade for a turbine made using a foundry method that used a core made by the method according to the invention.

BRIEF DESCRIPTION OF THE FIGURES

Other characteristics and advantages of the invention will become clear after reading the following detailed description with reference to the appended figures that show.

DESCRIPTION

In this description, the "flash point" or "inflammability point" refers to the lowest temperature at which a body or a combustible material emits sufficient vapour to form a gaseous mix with ambient air that inflames under the effect of a heat energy source.

Throughout the remainder of the description, the term "coating" step will be used to refer to the coating applied according to this patent application.

A ceramic core for a turbine blade comprises a lower part forming a core body, an upper part forming a recess and a set of rods contributing to holding the upper and lower parts to each other. The upper and lower parts are fixed to each other. In one simplified embodiment of the invention, at least one rod contributes to holding the two parts of the core in place.

Figure 1:
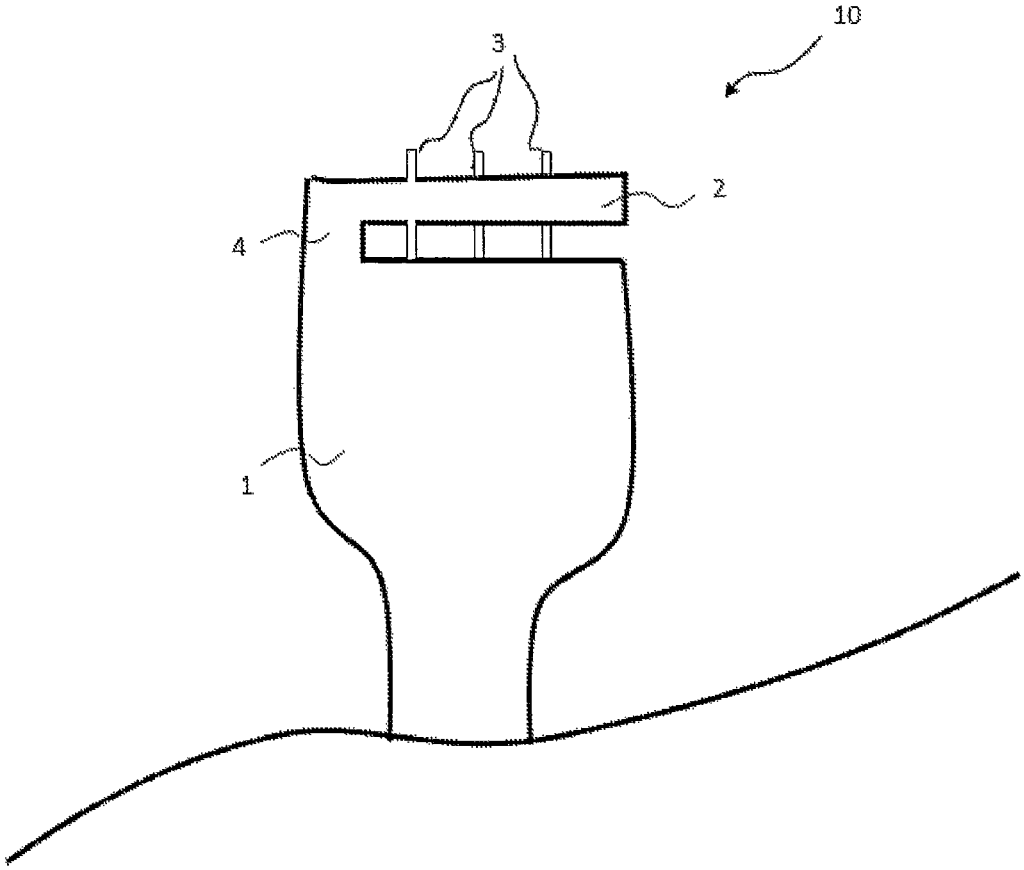
FIG. 1: a view of a ceramic core for mobile blades.

Depending on the embodiment, the upper and lower parts may comprise a common zone that also contributes to holding the two parts together. FIG. 1 shows such an embodiment in which the parts 1 and 2 are also held together by a common zone 4 located on the side of the core.

Figure 4:
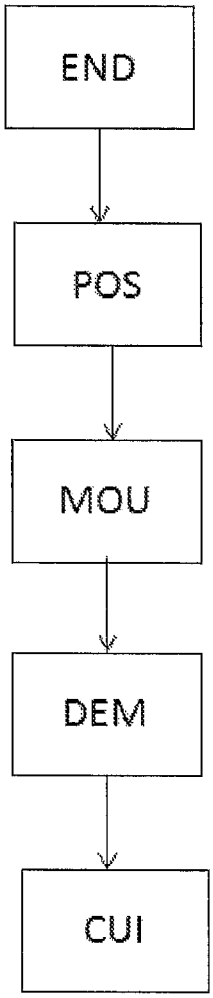
FIG. 4: a diagram showing the main steps in the method according to the invention.

The method of manufacturing a ceramic core according to the invention comprises a coating step denoted END in FIG. 4, of the rods before they are inserted into a mould for moulding the ceramic parts. The varnish is deposited on the part of the rod that will be surrounded by the recess in the core. In one embodiment, the part of the rod that is surrounded by the core body is not covered with varnish.

In one particular embodiment of the invention, the rods may be coated after they have been positioned in the mould. But preferably the rods are coated before they are inserted in the mould so that the entire surface of the rod is covered uniformly, Rods may be coated in different ways, depending on the type of material applied, the thickness of the required coat and/or the part of the rod or rods to be covered.

In one embodiment of the invention, the entire rod is coated with a material with a flash point of less than 1000° C.

In another embodiment, only the part of each rod surrounded by the recess is covered with a rendering. The part of the rod surrounded by the core body is not coated with varnish. One advantage is that the quantity of varnish is adapted to the part of the structure weakened by expansion of the rod.

The temperature limit of 1000° C. corresponds to the temperature at which transformation of ceramic materials forming the core begins. This limit is thus a particularly interesting temperature so that the material applied on the rod will inflame before the firing temperature reaches this limit. It is also possible to choose lower limits that will function at least as well as long as the temperature of the flash point of the material is below this limit.

In general, a temperature threshold is chosen such that the coating material such as a varnish inflames before the rod expands. Expansion is assumed to be effectively zero below a certain limit. In one embodiment, this limit is fixed at 1% which corresponds to 1% expansion of the rod dimensions. According to other embodiments, the predefined proportion defining the so-called "consequent" expansion limit may be more than 1% and up to 2% or even more depending on the materials used and their dimensions.

In different embodiments, the material may be applied either by dipping the rods or by application of the material on the rods, for example with a brush.

In one preferred embodiment, the applied material is a varnish. This varnish may for example be a "nail varnish" type. The varnish application method may then be applied on the rod using a brush in a conventional manner like a woman would apply varnish to her finger nail An appropriate varnish includes solvents, resin, nitrocellulose and plastifiers. For example, a varnish like a "Thixotropic base" varnish marketed under the trade name PEGGY SAGE NAIL VARNISH ALL FORMULAS may be used in the method according to this invention.

Once the varnish has been applied on the rod, the rod is placed in a mould. Preferably, the rod is positioned according to a step of the method denoted POS, after the varnish has dried. The position of each rod in the mould is such that when the material is injected, it will surround each rod.

The method includes a moulding step denoted MOU in FIG. 4, comprising an injection of ceramic in the mould. Injection of the ceramic forms the core in the housing provided for it, thus forming the body and the recess depending on the shape of the mould.

The ceramic moulding step comprises moulding of the lower part forming the core body and moulding of an upper part forming a recess. The two parts are preferably moulded at the same time. The rods are positioned such that part of the rod is in the upper part of the core and part of the rod is in the lower part of the core. The ceramic material injected into the part of the mould forming the recess surrounds the part of the rod present in the recess and the ceramic material injected into the part of the mould forming the core body surrounds the part of the rod positioned in this part of the mould.

After moulding, the rod holds the two parts of the core together.

In another step in the manufacturing method according to the invention, the core is then removed from the mould, this step is denoted DEM in FIG. 4. The rod or rods fixed to the two parts of the core is (are) thus also taken out of the mould, A firing step of the core thus removed from the mould, denoted CUI in FIG. 4, can then be initiated.

While the core is being fired, the varnish covering the rods reaches its flash point before expansion of the rod reaches consequent proportions. Thus, the coefficient of expansion of alumina at 1200° C. is 1.03%. Consequently, burning or inflammation of the varnish occurring at the flash point of the varnish takes place at a temperature lower than the firing temperature that causes expansion of the alumina rod.

Inflammation of the varnish releases a space all around the rod before it expands. The rod moulded in the lower and upper part of the core then expands under the effect of firing with increasing temperature. One advantage of the varnish coat applied on the rod and that burned is that it leaves a space around the rod, said space providing the additional space required by its expansion. Therefore the quantity of varnish applied on each rod can be chosen so as to adapt the space created around the rod to match the additional volume occupied by expansion of the rod.

Depending on the embodiment, tests can be used to choose the type of material used to cover the rods and to choose the appropriate thickness of said coats when they are applied on the rods. These tests can determine the ideal space released by the material that burned to correspond to the space required for expansion of the rod during firing.

Consequently, during and after firing, expansion of the rod no longer imposes a mechanical stress on the ceramic material surrounding it that could cause a crack.

In previous solutions, it was found that cracking often occurred in the recess. Since the recess is thinner than the core body, cracks caused by resistance to internal expansion of the rods occurred principally in the recess.

Figure 2:
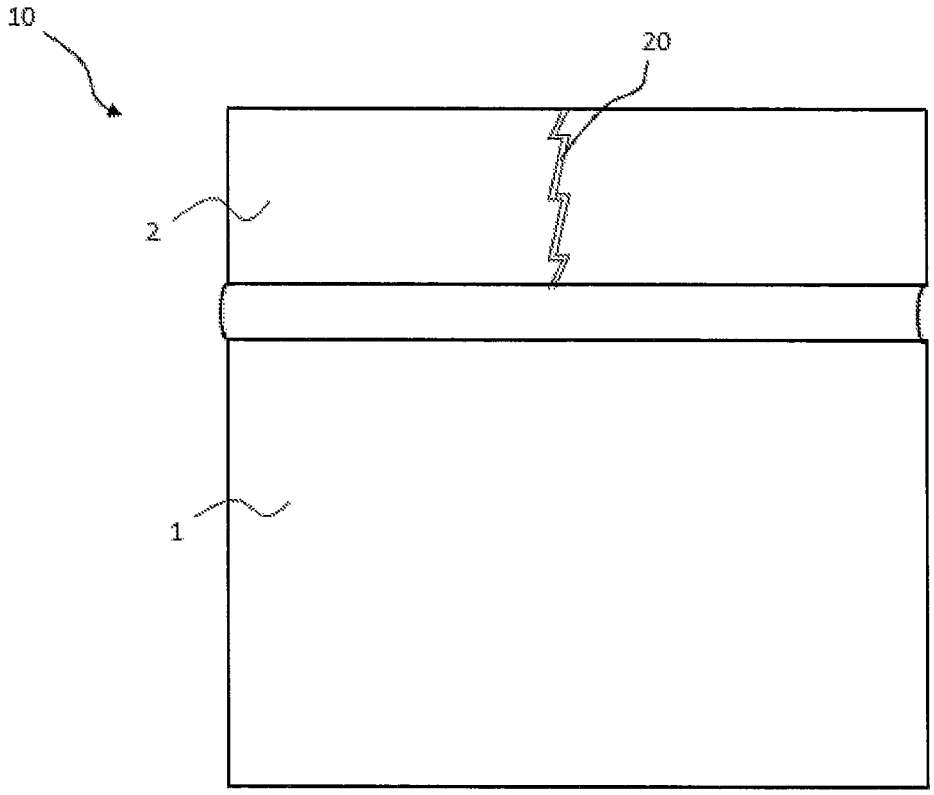
FIG. 2: a view of a ceramic core after firing and formation of a crack on the recess in the core.
Figure 3:
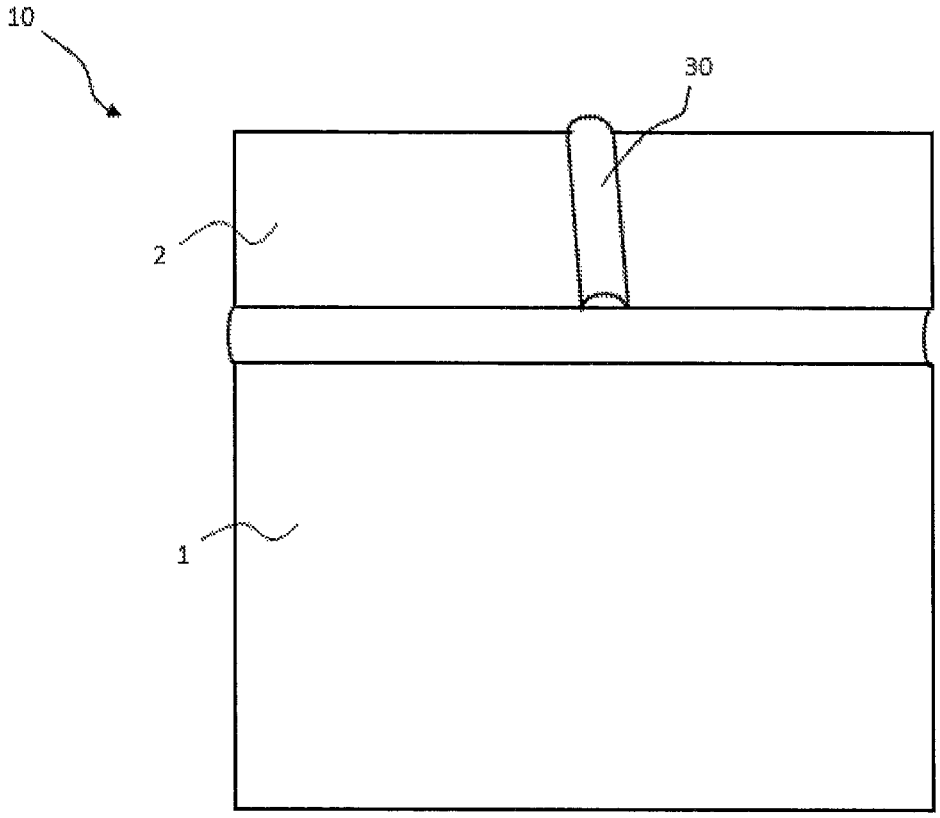
FIG. 3: a view of a ceramic core comprising an over-thickness to compensate for the formation of a crack.

The crack that might form shown particularly in FIG. 2, no longer appears when the rod is impregnated with a material such as varnish. Due to this preliminary step in which the rods are coated by an inflammable material, there is no longer any need to apply an overthickness on the surface of core recess.

The steps in the method according to the invention are preferably executed in sequence. But in one embodiment, it could be envisaged that the coating step of each rod is performed after the rods have been put into the mould. On the other hand, it appears inevitable that moulding and firing should be done sequentially if the invention is to function satisfactorily.

Other products with approximately equivalent properties as the varnish may be used for replacement during the coating step according to the invention.

All products that can be used in this invention enable a deposition of a thin coat, for example a few hundredths of a millimeter. The products applied to the rods must be eliminated by firing before expansion of the alumina rod. In preferred embodiments of the invention, it is also important that these products used as coatings for the rods should not leave any undesirable chemical residues.

Each of the products listed below has its own advantages, so that it may be preferred to others depending on required operational choices.

Apart from varnish, products that might be envisaged to bond to the rod by making a thin coat and to burn before 1000° C. without leaving any residues include wax, resin, paint and/or graphite.

These products have the following advantages:

- they bond to the rod when they are applied to its surface;
- it is easy to apply a deposit in a thin coat;
- a uniform deposit can be made over the entire surface of the rod;
- finally, they are all eliminated by firing at a temperature below 1000° C.

Resin is preferably chosen so that it does not contain any material that could pollute the furnaces when firing the cores.

For graphite, combustion may advantageously be controlled so as to avoid or limit emissions of carbon monoxide. Finally, combustion may be controlled so as to provide a sufficiently oxidising atmosphere during firing.

One advantage of wax is its plasticity and malleability at ambient temperature that makes it particularly useful for coating a rod. Its melting point of 45° C. releases a space around the rod before expansion of the rod. Another advantage lies in its low viscosity when it is molten so that it releases a uniform space around the rod.

The method according to the invention may include ceramic sintering and resin coverage steps after the core has been fired.

The invention also relates to a ceramic core obtained by the method according to the invention. The ceramic core according to the invention has the special feature that it can be made by the use of rods coated with a material with a flash point lower than the expansion temperature of alumina.

The invention also relates to a mobile turbine blade comprising a ceramic core obtained by the method according to the invention.

The invention claimed is:

1. A method of manufacturing a ceramic core for a blade comprising a lower part forming a core body, an upper part forming a recess and a set of rods contributing to holding the upper part with the lower part, the method comprising:

coating the rods with a material with a flash point below a temperature threshold above which the expansion of the rods is greater than 1%;

positioning the rods in a mould;

moulding the upper and lower parts by a ceramic injection, the moulded upper and lower parts thus forming a single part in the mould and defining a core shape;

firing the ceramic core, wherein during said firing of the ceramic core, the material is inflamed so that a space is released between the upper part of the ceramic core and the rods.

2. The method of manufacturing a ceramic core according to claim 1, wherein the coating, the positioning, the moulding and the firing are performed in sequence.

3. The method of manufacturing a ceramic core according to claim 1, wherein the temperature threshold is 1000° C.

4. The method of manufacturing a ceramic core according to claim 1, wherein the expansion is greater than 2%.

5. The method of manufacturing a ceramic core according to claim 1, wherein a mould removal of the core precedes the firing of the core.

6. The method of manufacturing a ceramic core according to claim 1, wherein each rod is coated on a surface that is surrounded by the recess.

7. The method of manufacturing a ceramic core according to claim 1, wherein the coating on part of the rods is a varnishing with a varnish coat.

8. The method of manufacturing a ceramic core according to claim 1, wherein the coating of the rods comprises depositing a coat of wax on a part of a surface of each rod.

9. The method of manufacturing a ceramic core according to claim 1, wherein the coating of the rods comprises depositing a coat of resin on a part of a surface of each rod.

10. The method of manufacturing a ceramic core according to claim 1, wherein the coating of the rods comprises depositing a graphite coat on a part of a surface of each rod.

11. A method of manufacturing a ceramic core for a blade comprising a lower part forming a core body, an upper part forming a recess and a set of rods contributing to holding the upper part with the lower part, the method comprising:

coating the rods with a material with a flash point below a temperature threshold above which the expansion of the rods is greater than 1%;

after said coating, positioning the rods in a mould;

after said positioning, moulding the upper and lower parts by a ceramic injection, the moulded upper and lower parts thus forming a single part in the mould and defining a core shape, and after said moulding, firing the ceramic core, wherein during said firing of the ceramic core, the material is inflamed so that a space is released between the upper part of the ceramic core and the rods.

* * * * *